US006135076A

United States Patent [19]

Benlloch Martinez

[11] Patent Number: 6,135,076

[45] Date of Patent: Oct. 24, 2000

[54] DEVICE TO ACTIVATE THE VARIABLE DISTRIBUTION VALVES OF INTERNAL COMBUSTION ENGINES

[76] Inventor: Jose Benlloch Martinez, Calle Dr. Beltrán Bigorra No. 6, Valencia, Spain, 46003

[21] Appl. No.: 09/296,600

[22] Filed: Apr. 23, 1999

[30] Foreign Application Priority Data

Apr. 23, 1998 [ES] Spain ..... 9801075

[51] Int. Cl.[7] ..... F01L 13/00; F02M 3/09

[52] U.S. Cl. ..... 123/90.16; 123/90.17; 123/90.24

[58] Field of Search ..... 123/90.15, 90.17, 123/90.24, 90.25, 90.26, 90.31, 90.39, 90.44, 90.6

[56] References Cited

U.S. PATENT DOCUMENTS

| | | | |
|---|---|---|---|
| 3,430,614 | 3/1969 | Meacham | 123/90.24 |
| 4,763,615 | 8/1988 | Frost | 123/90.25 |
| 4,928,650 | 5/1990 | Matayoshi et al. | 123/90.24 |
| 5,048,474 | 9/1991 | Matayoshi et al. | 123/90.18 |
| 5,431,132 | 7/1995 | Kreuter et al. | 123/90.16 |
| 5,586,527 | 12/1996 | Kreuter | 123/90.15 |
| 5,592,906 | 1/1997 | Kreuter et al. | 123/90.16 |

*Primary Examiner*—Weilun Lo

*Attorney, Agent, or Firm*—Jacobson, Price, Holman & Stern, PLLC

[57] ABSTRACT

Variable gas exchange valves of internal combustion engines include two camshafts, upper and lower, with cams for the combined operation of the valves, so that the upper camshaft acts and contacts a first rocker arm mounted on a fixed shaft and, on its end of greater rocker movement, the first rocker arm has a shaft in pin form which is a mobile shaft of a second, lower, rocker arm of angular form, upon which the lower camshaft cam contacts. The second rocker arm pivoting on the mobile shaft and, because of its angular form, the opposite end to that contacting the lower cam is applied to a valve stem, opening being performed by just one of the cams while closing is the sole consequence of the operation of the other cam, always in combined complementary action.

2 Claims, 7 Drawing Sheets

Figure 1:
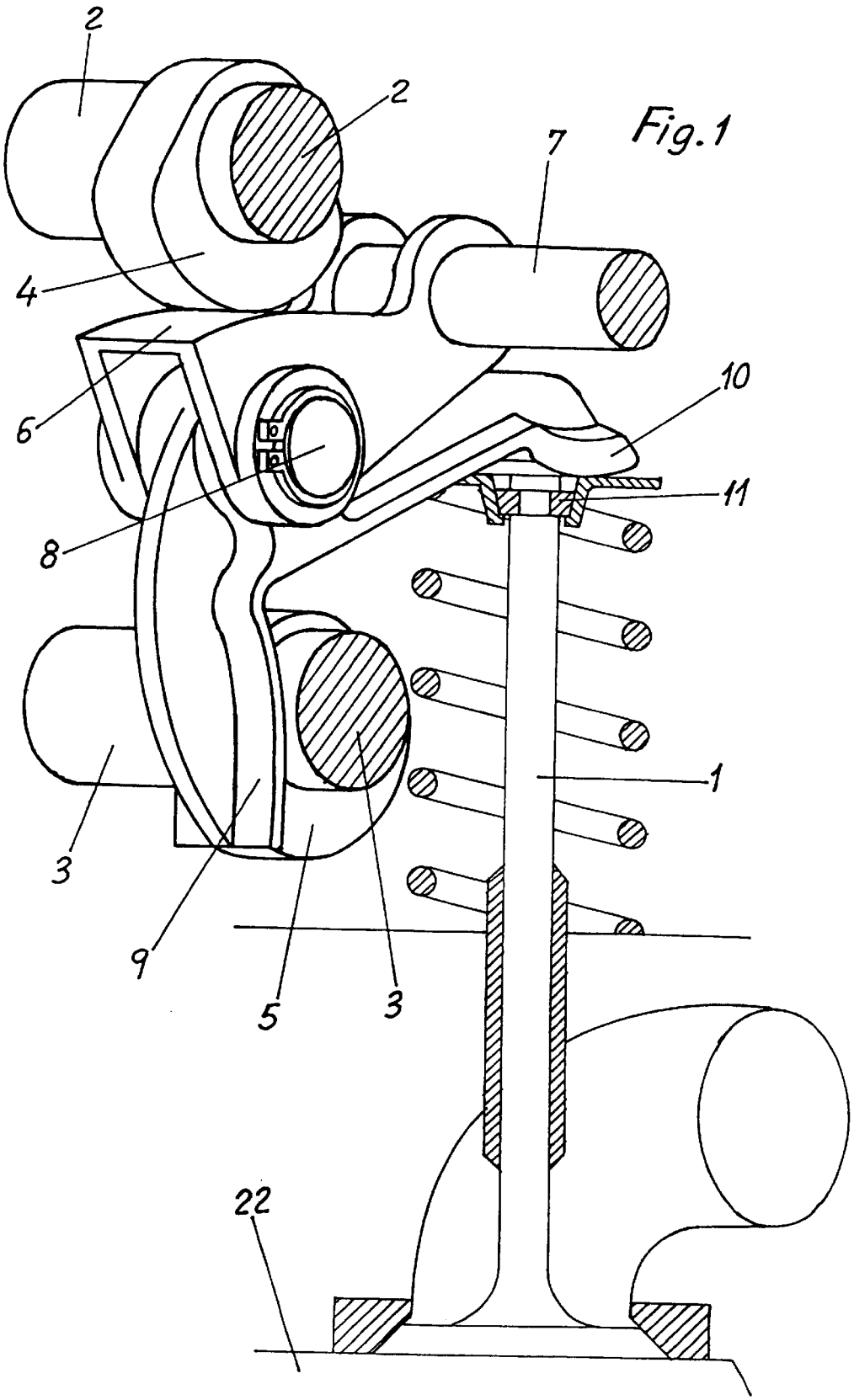

DEVICE TO ACTIVATE THE VARIABLE DISTRIBUTION VALVES OF INTERNAL COMBUSTION ENGINES

SPECIFICATIONS

The invention referred to in these Specifications and with the aid of the additional accompanying drawings is for a new device to activate valves, with a variable distribution system for internal combustion engines, the improvements to which constitute a manifest novelty in the motor vehicle field and whose many practical advantages are listed below, and which has structural and design characteristics significantly different from all the resources known until now for these purposes so that, along with its qualities of novelty and practical utility, they are deemed sufficiently founded to be granted the exclusive right hereby sought in respect of its manufacture and sale by the holder in Spain as a consequence of this registration of a Model of Utility.

Prior to specifying the features of this registration, a brief summary is first given of the theoretical cycle of the four-stroke motor, so-called precisely because its cycle is defined by four clearly-differentiated strokes—admission, compression and explosion, expansion and exhaust. During admission, the admission valve remains open and the piston moves from top dead centre to bottom dead centre, with a 180° turn of the crankshaft so that, as the piston moves, a chamber is formed in the cylinder which is filled with air or mixture, according to the engine type, under the force of atmospheric pressure. Thus, always on a purely technical basis, when the piston reaches bottom dead centre, the admission valve is closed to prevent further air or mixture input during the following strokes.

For compression and explosion, from bottom dead centre the piston moves during this stroke to top dead centre, turning the crankshaft a further 180°. During this stroke, as the valves are closed, with the reduction of the chamber inside the cylinder, the gases are compressed and, at the end of the stroke, theoretically with the piston at top dead centre, ignition occurs, followed by combustion and an increase in the pressure inside the cylinder.

Because of the high pressure created inside the cylinder during this second stroke, expansion is transmitted according to the rules of physics to the mechanical elements in all directions so that the thrust on the piston, the only component able to move, means that it is displaced toward bottom dead centre. This is the only active cylinder stroke, i.e. the only one in which the pressure generated during combustion is transmitted to the engine components.

Finally, exhaust is the fourth and final stroke of the cycle, in which the piston is moved again from bottom dead centre to top dead centre, this time with the exhaust valve open and through which the burnt now useless gases are expelled.

Following this explanation, a brief description is now given of the practical cycle of the four-stroke motor in which, for very varied reasons, things do not occur as in the theoretical cycle, some of these circumstances being considered here.

In the first place, following the piston stroke, where the admission stroke does not occur along the x axis, this is because the atmospheric pressure is not immediately able to fill the chamber created in the cylinder because the piston movements are in fact very fast and the gases have to move very quickly in the piping, affected by the friction, with the result that the pressures created in the cylinder are lower than atmospheric pressure and, toward the end of this stroke, when the piston reaches bottom dead centre, it has not yet been able to compensate the pressure inside the cylinder with the atmospheric pressure.

Apart from the friction as such, it must be remembered that the valves cannot open and close instantaneously as in the theoretical stroke and this even further conditions the input of gases to the cylinder.

Engine manufacturers try to reduce this detrimental effect with a variety of actions, of which two are highlighted here as the most interesting to this study:

1) By making the admission valve open before top dead centre, known as admission opening advance.

2) By making the valve close once bottom dead centre is passed, when the piston has begun to rise and so reduce the chamber in the cylinder but while gas input continues because the pressure is less than atmospheric pressure. This is called admission close retard, and it is when the admission valve is really completely closed that the compression stroke begins.

According to the theoretical cycle, gas ignition and combustion are considered instantaneous but in this too the reality diverges from the theory. As a result, manufacturers advance the point at which ignition begins in relation to top dead centre so that it can be considered that, normally, combustion ends when the piston has passed that point or, at most, when the piston is exactly at top dead centre. The gas expands following combustion: this study does not examine this phase, despite its being the only active stroke, so no considerations are offered in this respect.

As with the opening and closing of the admission valve, the exhaust valve also requires a certain time for its movement, so that manufacturers make the exhaust valve begin to open ahead of bottom dead centre and to complete closing when the piston has passed top dead centre, after the stroke for the expansion of the burned gases: these variations are respectively known as exhaust opening advance and exhaust close retard.

As will be revealed throughout this description, the engine operating conditions are significantly altered according to the engine's running regime at any time, largely because the values adopted by each manufacturer for admission opening advances, admission close retards, exhaust opening advances and exhaust close retards are fixed and unchanging for these parameters using present valve operation procedures.

Within the practical cycle of variations, the most important of the four parameters introduced and explained above is the retard in closing admission and, while the others also have an influence on the engine's operation, that parameter is to receive particular attention in the following explanations.

At the slowest turnover, with the piston movement speed lower, the chamber takes longer to fill and so the speed of circulation of the gases through the piping is lower with the result that the atmospheric pressure is completely restored inside the cylinder even before reaching the point of delay in the closing of admission and the admission valve is still open, at which point the gases begin to be expelled along the duct through which they entered, that is through the admission valve, while it is open.

The first direct consequence is that part of the gas volume already in the cylinder is lost and, with it, part of the potential energy to be created. This gas feedback also creates other, lesser problems as a result of changes of direction of the flow.

Once the delay in admission closure is reached, and the admission valve is completely closed, compression as such begins; however, with the engine at its slowest, the gas cooling time is longer, so that the degree of compression reached at the commencement of combustion is lower and, largely for this reason, combustion is slower and creates less pressure inside the cylinder, with the consequent loss of engine torque.

When the engine is running faster, above that considered in the graphic as ideal (or maximum torque), the time for gas entry to the cylinder is significantly shorter so that the pressure inside the cylinder drops even further below atmospheric pressure. As a result, admission close retard is reached when the pressure in the cylinder is still below atmospheric pressure and it is unable to reach atmospheric pressure until the point of admission close delay is well past.

This leads to a loss of much of the volume which may be used to fill the cylinder, so that the degree of compression reached at the moment of combustion onset is significantly lower than desirable, making combustion slower and leading to the creation of less pressure in the cylinder.

In the traditional valve-action system, depending on the type of engine and its use, this design may be subject to very many variations, although all retain the general principal of a cam whose end thrusts on the valve stem thereby moving the valve and opening the duct. Similarly when the cam ceases acting on the valve stem, the valve is moved by a spring, air system or some other means to its initial position, once more closing the duct.

The shape and size of this cam are adapted according to testbed experiments. For each engine, maximum torque should occur at the running rate determined by the manufacturer according to engine use. It is known that the angles and dimensions of the cam and the point where it is fixed to its operating shaft condition engine performance at different regimes, since such values are optimal for a given engine running regime.

The improved valve-action device makes use of two cams to activate each valve, said cams being applied to the valve stem with two intermediate oscillating components to transmit the thrust, with the eccentric form of the first cam applied to a rocker arm which is able to rock on a fixed shaft. This rocker arm supports the shaft on which a second moving-shaft rocker arm is fitted and which, in turn, is operated by a second cam fitted on the lower camshaft, so that one end of the mobile-shaft rocker arm is in contact with the cam while the other end, in angle, is applied to the valve stem to operate the valve.

This description makes clear that this is a mechanism which is differentiated from existing systems by using two cams to operate one valve, each independent in its action, with the specification that opening is done by one only of the cams, so that closing is the exclusive province of the operation of the other cam.

This novelty makes it possible to separate the opening and closing movements, from which it is inferred that a variation in the moment of commencement of the opening can be made completely independent from the moment of commencement of closure: with the right mechanisms, this makes it possible to vary the key points of valve opening and closing at will and with the engine running and which, as explained at the outset, are of vital importance in obtaining the best results from the engine in all running regimes.

Another novelty in this device is that the mechanical system for varying the camshaft timing consists of a bushing fitted between the gear receiving and transmitting the crankshaft rotation, in a ratio of 1:2, and the camshaft as such. This bushing has two sets of helical cut teeth, inside and outside, so that its outer toothing coincides with that of the gear inside, allowing the gear to fit perfectly on to the cap, using a sliding toothed shaft.

Similarly, the internal bushing diameter toothing coincides with that on the end of the camshaft so that they fit perfectly together and the bushing can slip along the shaft although forced to turn with it by the coupling of the teeth. It is emphasised that the teeth are helical and the helical form of each is the reverse of the other.

With this layout, as shown in the two sequences illustrated, when the bushing slips axially, an offset occurs between the gear and the shaft, making it possible, continuously and at will, to vary the angular setting of each camshaft in relation to the crankshaft.

For a better understanding of the general features set out, drawings are included showing, graphically and diagrammatically, a practical embodiment of the improved operating device for variable-distribution valves in internal combustion engines which is the subject of this registration. It is pointed out that, because of the eminently informative nature of these drawings, the figures they contain must be examined with the broadest criteria and without any limitation.

The figures represented in the attached drawings show the following:

FIG. 1.—A perspective projection with conventional cross-sections of the improved valve-operation device, incorporating an upper camshaft with its eccentric cam acting on a fixed-shaft rocker arm, with this rocker arm incorporating a mobile shaft where a second rocker arm is installed, this one with a mobile shaft, activated by the lower camshaft eccentric cam so that the mobile-shaft rocker arm presses on the valve stem.

Figure 2:
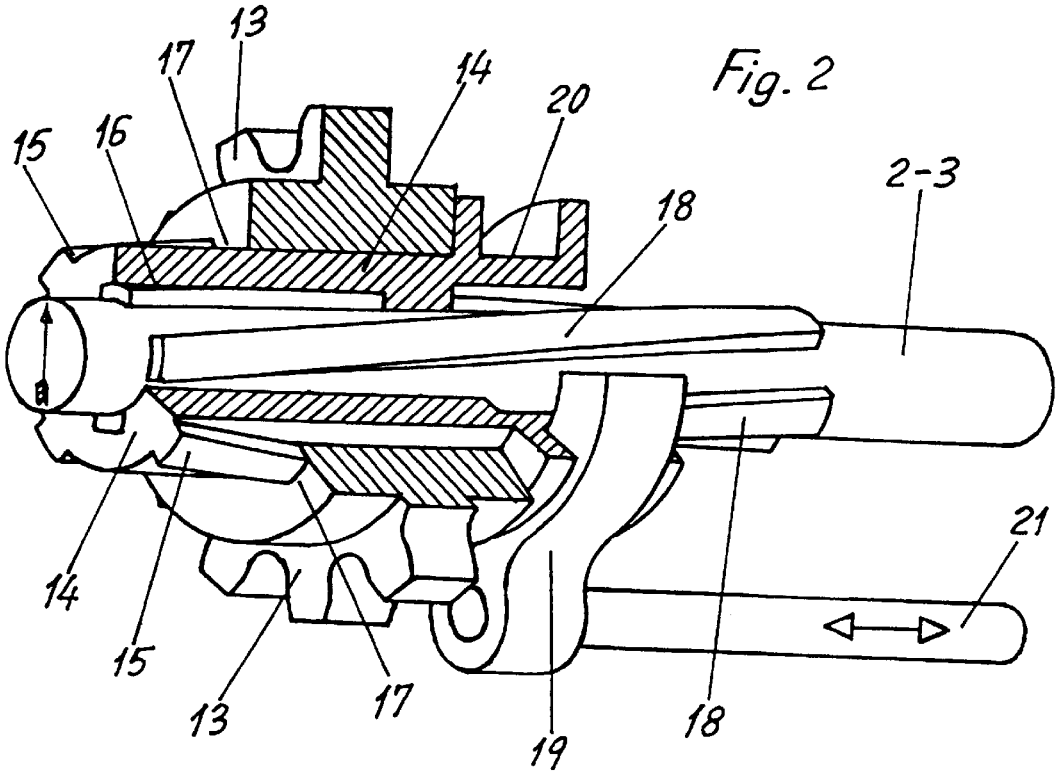

FIG. 2.—A perspective view and cross-section of the mechanism for varying the camshaft timing, where a bushing with two helical sets of teeth, one each inside and outside, is fitted between the gear and the camshaft. The outer toothing of said bushing coincides with that of the gear inside, so that it fits perfectly on to the cap, acting as a sliding toothed shaft, and the toothing of the inside diameter of the bushing coincides with that on the end of the camshaft. It is emphasised that the teeth are helical and the helical form of each is the reverse of the other. An axial movement fork is housed in a neck in the sliding cap, operated by a rod which, in this case, moves the bushing toward the left of the camshaft.

Figure 3:
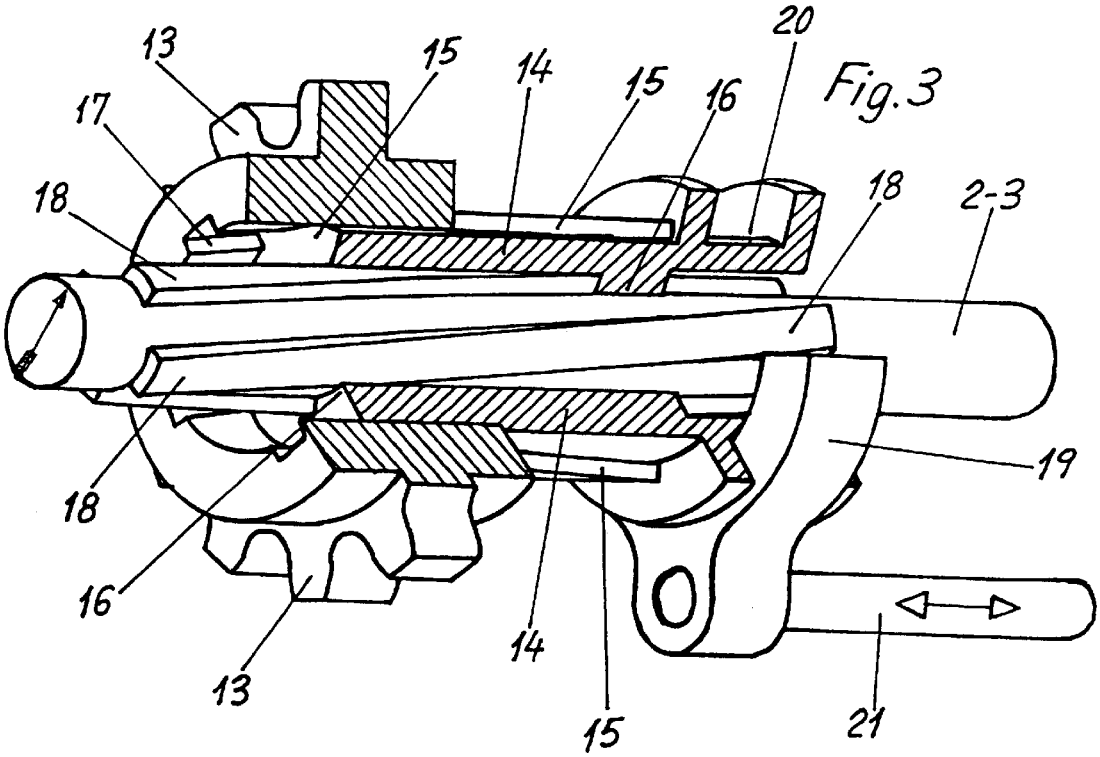

FIG. 3.—The same perspective view as in FIG. 2, but with the bushing moved fully to the right, so that the offset between the gear and shaft has changed, enabling the angular setting of each camshaft to the crankshaft to be altered continuously and at will.

Figure 4:
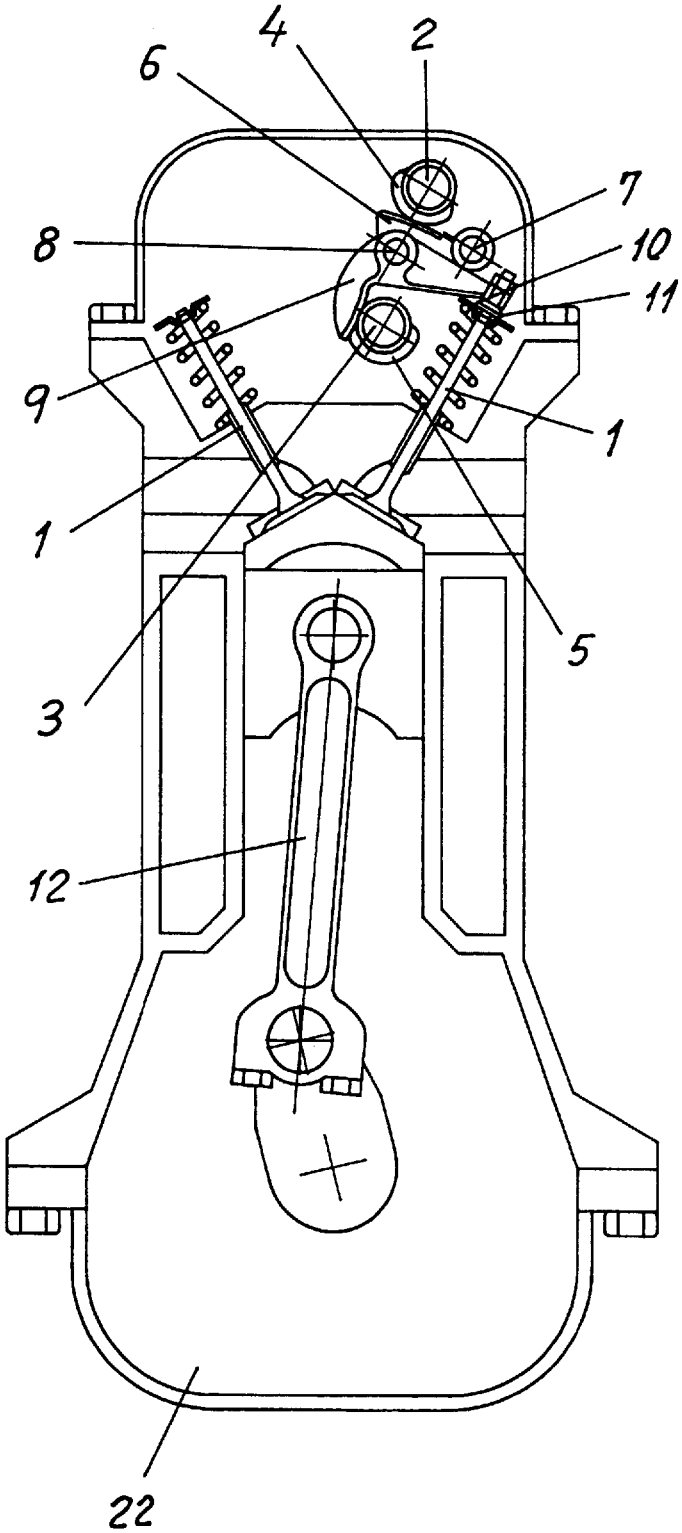

FIG. 4.—Is a diagrammatic elevation view of the cross-section of an engine, through a cylinder, showing the arrangement of the mechanisms for operating one of the valves. They also apply to the operation of the other, as a general principle, though the parameters to be used are variable. It is assumed to be an admission valve and the moment shown in this figure is that of admission opening advance, where the cycle really begins. It is also assumed, for purely explanatory purposes, that the admission opening advance is 14°, that is, that the crankshaft is 14° before the situation where the piston reaches upper dead point. It is shown how the upper camshaft already applied its largest-diameter area to the fixed-shaft rocker arm, preventing it from moving back: however, the particular form of the mechanism means that this movement was not applied to the valve stem so that the admission valve has yet to move, while the lower camshaft has not yet applied its upward flank to the mobile-shaft rocker arm but is in fact just about to do so.

Figure 5:
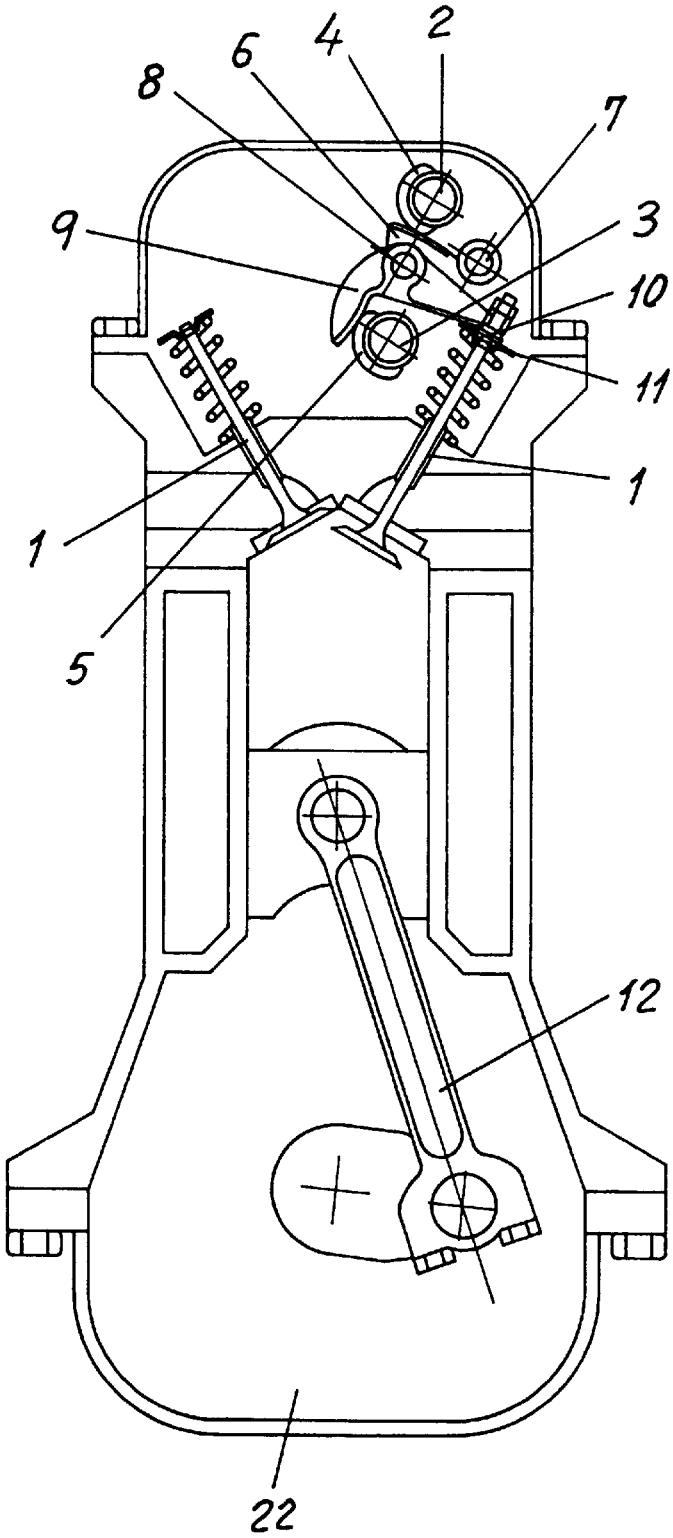

FIG. 5.—The same graphic representation as in FIG. 4, where the crankshaft has supposedly turned through 112° and the camshafts through 56°, showing that, in the valve-operation mechanism, the upper camshaft has turned through its 56°, constantly applying a concentric surface with its rotation shaft on the fixed-shaft rocker arm, which has not therefore changed position: at the same time, the lower camshaft has moved through 56° and applied its upward flank to the mobile-shaft rocker arm which has pivoted on its shaft and tipped to push the valve which opens the duct. It is emphasised that, in this case, the upper cam is about to begin its downward run, placing the valve at the commencement of closure.

Figure 6:
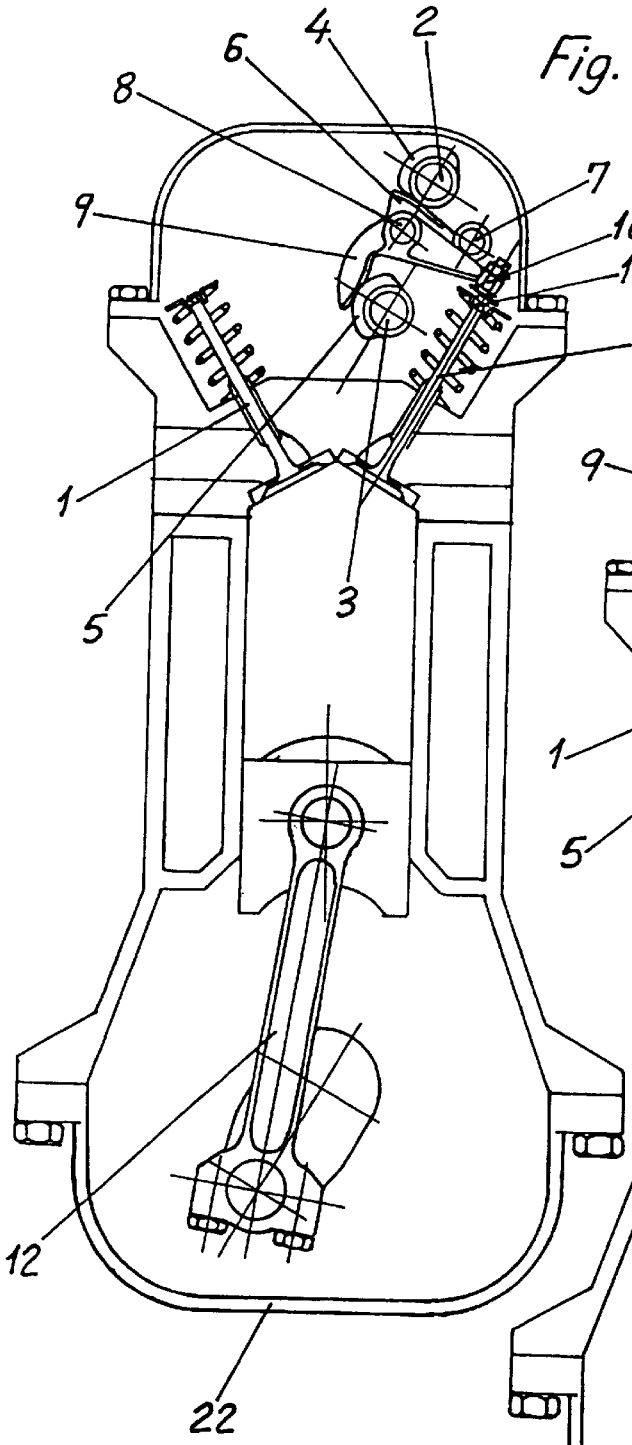

FIG. 6.—The same view as in FIGS. 4 and 5, but now with the crankshaft having turned through a further 112° (56° for the camshaft) so that, since the cycle began, according to FIG. 4, the crankshaft has turned 224°. Now the crankshaft has gone 30° beyond bottom dead centre. The valve action mechanism has, in its 56° turn, applied a concentric surface on the mobile-shaft rocker arm, and so has not had any effect on it, while the upper camshaft cam has applied its downward flank to the fixed-shaft rocker arm which is moved by the back thrust transmitted to it from the valve spring through the mobile-shaft rocker arm and its rotating shaft on the fixed-shaft rocker arm. As a result of this movement, the valve is once more closed: this is the point of admission close retard, fixed for these purposes at 30° after bottom dead centre. It is emphasised that valve closure is possible thanks to the individual action of the upper camshaft cam, without involving the lower camshaft cam which is at all times a neutral surface, concentric with its axis of rotation.

Figure 7:
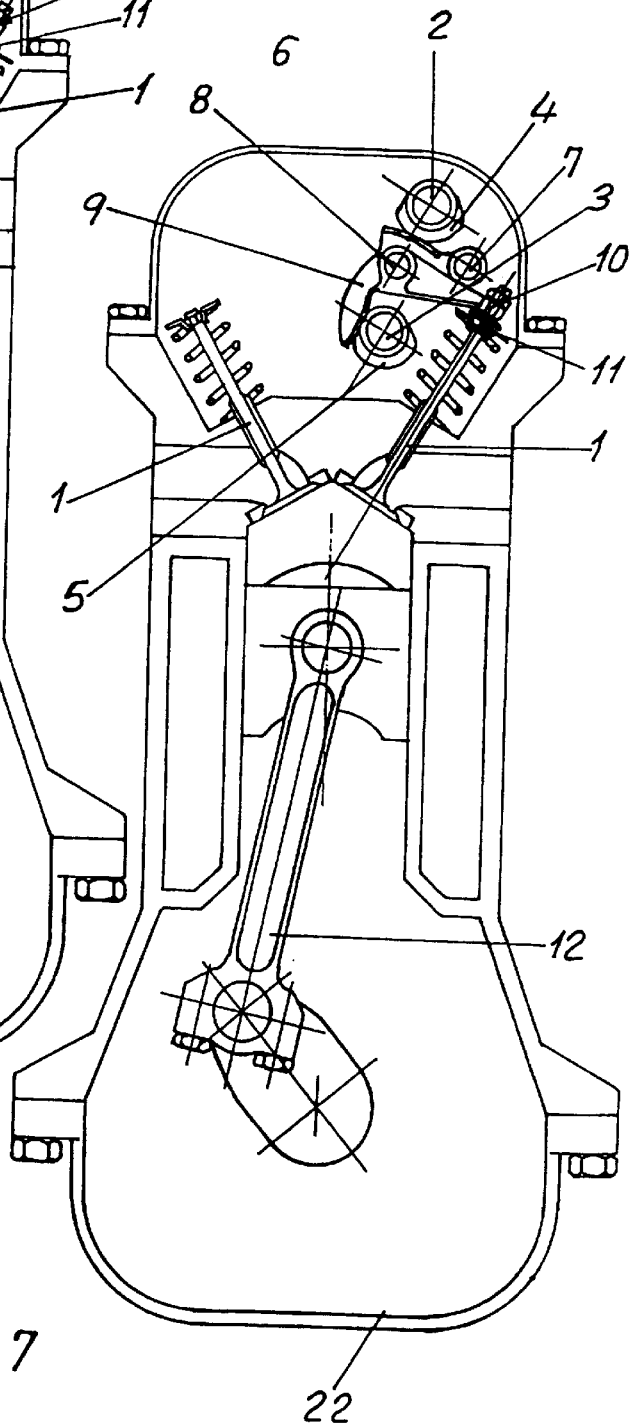

FIG. 7.—A representation similar to that in FIG. 4, both showing the point of admission opening advance. If the two figures are compared, it is seen that the crankshaft position in relation to upper dead centre is not the same since, there, the advance was 14° while now it is 40° while, in both figures, the lower camshaft cam is precisely in the angular position. To reach this situation, the sliding toothed bushing shifter will have acted on the lower camshaft to advance it against the crankshaft since, if the crankshaft is now 40° ahead of upper dead centre, in order for the relative position between the lower camshaft cam and the mobile-shaft rocker arm to be the same, the camshaft must have been advanced 13° against the crankshaft. Nor is the upper camshaft cam in the same position as in FIG. 4 because of the delay also produced in the closing of the valve.

Figure 8:
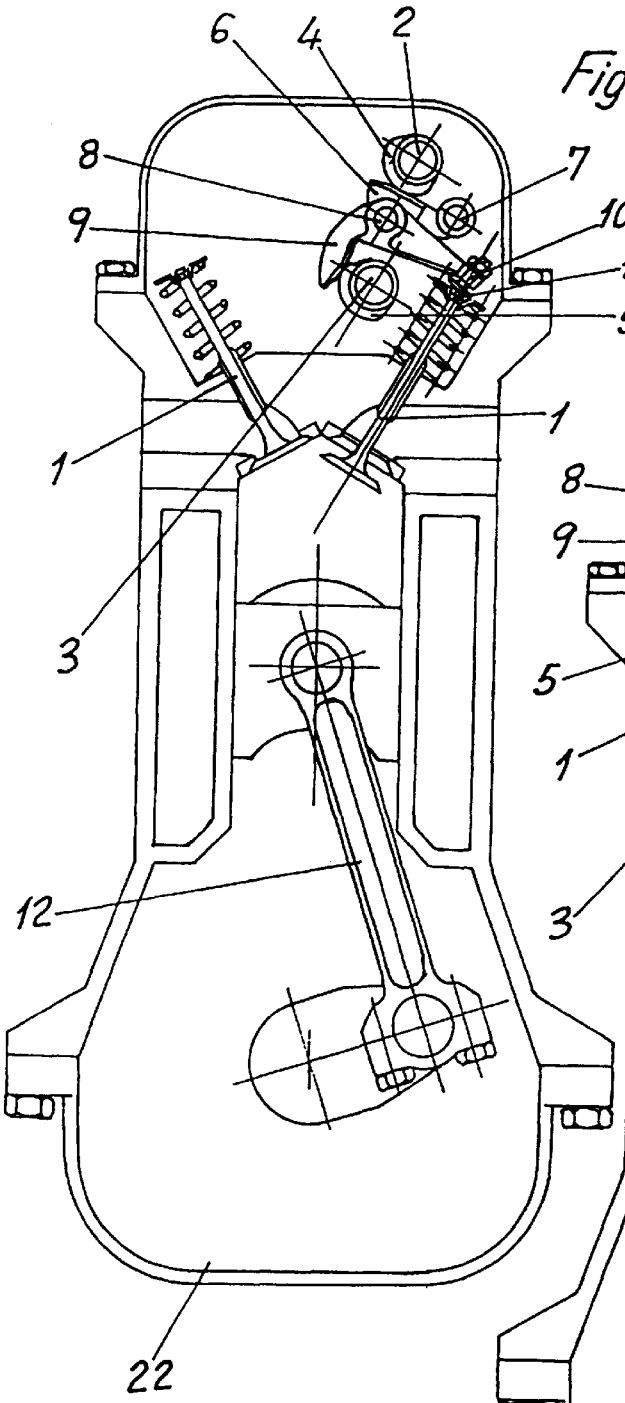

FIG. 8.—As in the previous case, this figure is comparable with FIG. 5. This details the moment of the end of the valve opening movement: the angular situation of the crankshaft is not the same in both figures because of the delay referred to. It may however be remembered that, irrespective of the angular settings in relation to fixed points, the movement has taken place with the same angle of rotation, namely 112° for the crankshaft and 56° for the camshafts, with the valve open 72° after upper dead centre.

Figure 9:
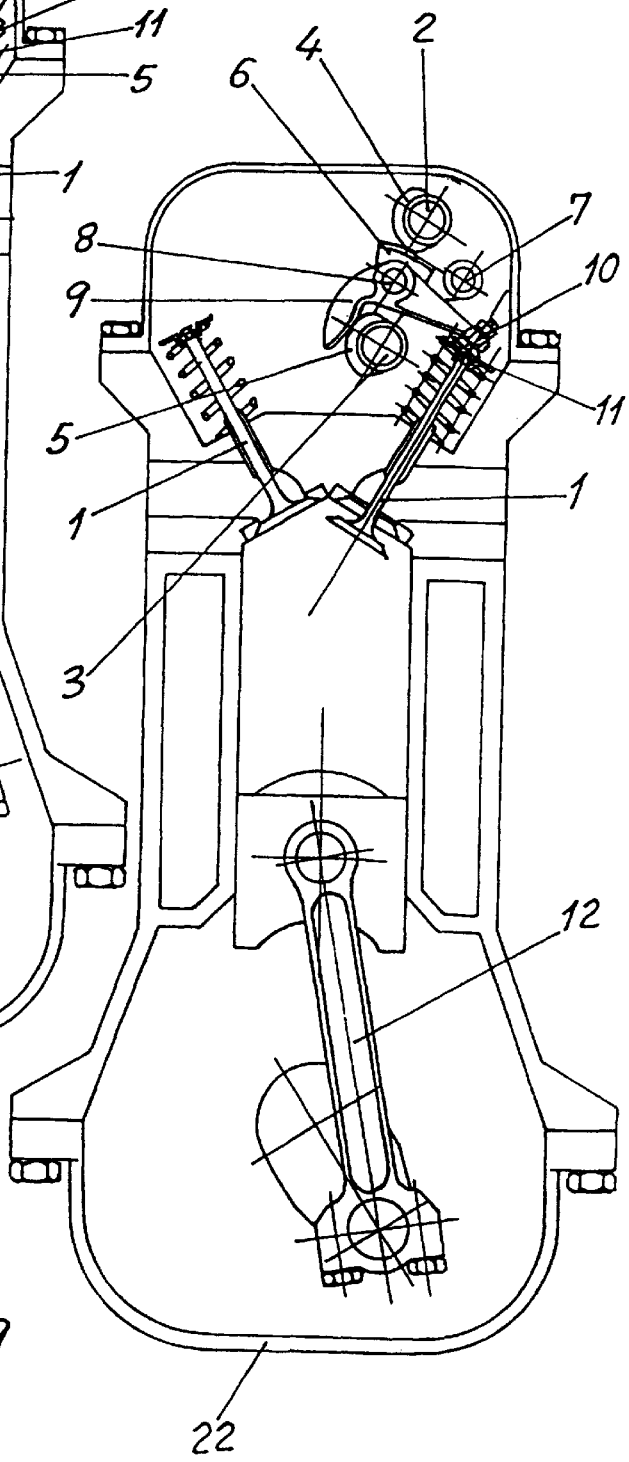

FIG. 9.—Between this figure and FIG. 8, the crankshaft has continued to rotate, to 188° since it began, and is now 32° ahead of lower dead centre. The valve is open and has not moved, and gas is able to enter the cylinder because, during this 76° rotation of the crankshaft, both cams have applied neutral surfaces to their rocker arms, concentric with their axes, so that their angular movement was not translated into any action of the rocker arms and valve. The upper camshaft cam is about to begin the downward flank to begin to close the valve: this is made possible by the action of the sliding bushing shifter, which has created a 25° delay against the crankshaft.

Figure 10:
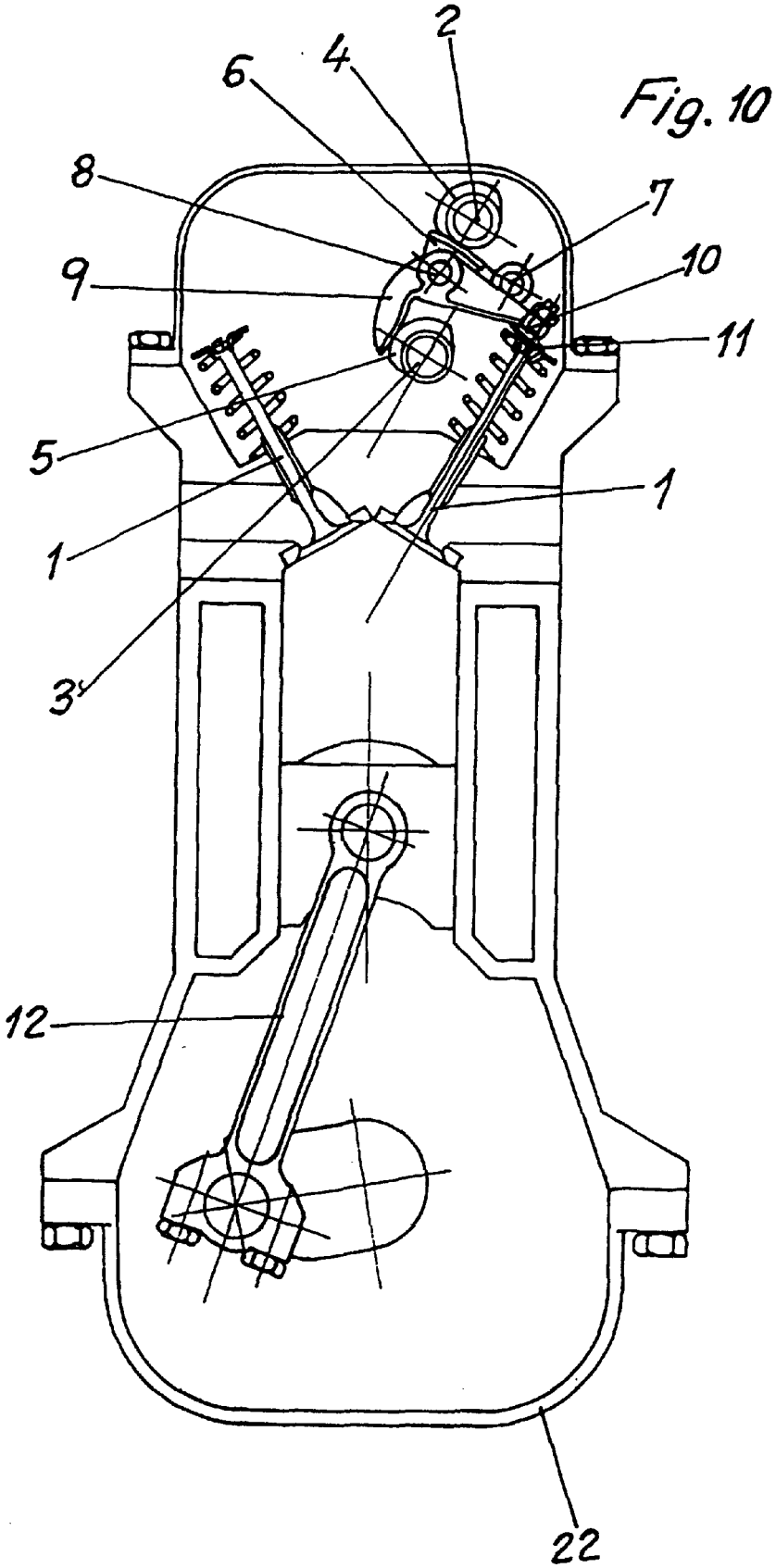

FIG. 10.—Here, the movement is comparable to that in FIG. 6: in both, the crankshaft has turned 112° (the camshafts 56°) from the position in the previous figure in each case, but with the significant difference that this has occurred with a crankshaft rotation from 82° ahead of bottom dead centre to 30° after bottom dead centre, while in the sequence in FIG. 10, the crankshaft began at 32° ahead of bottom dead centre and is at the point of admission closure retard as shown in the figure, 80° following bottom dead centre. A further difference to be borne in mind is that the angular position of the lower camshaft cam in relation to the mobile-shaft rocker arm is not the same but, as it continues to apply a surface to it which is concentric with its rotation axis, it does not in any way affect the valve closing action.

The following refers to the attached drawings which contain numerical references in the figures there, and associated with the following descriptions of their characteristics and operation so as to allow their immediate location, where -1- is one of the engine valves operated by the present improved device, this action being produced in combination by means of the upper camshaft -2- and the lower camshaft -3- with cams X- and -5- and operating so that cam -4- acts and pressures the rocker arm 6- which pivots on the fixed shaft -7-. The fixed-shaft rocker arm 6- has a further shaft -8- acting as a pin which constitutes the mobile shaft -8- of the rocker arm -9-. Thus cam -5- on the lower camshaft -3- acts on the rocker arm -9- so that, when tipped by its mobile shaft -8-, thanks to its angular form, its opposite end -10 applied to the stem -I I- of the valve -1-, operates it and causes it to open.

With this system, opening is operated by just one of the cams, and closure is left exclusively to the other. This mechanism is submitted as a novelty, allowing the opening movement to be made independent of closure, from which it may be inferred that a variation in the point of commencement of opening may be completely disassociated from the point of commencement of closure.

The camshaft or camshafts -2- and -3- receive the rotation movement through a transmission from the crankshaft -12- at a ratio of 1:2, with the adoption in this case of a system to vary the timing of the camshafts -2- and -3-, acting on this mechanism between the gear -13- and the camshaft as such, by means of the insertion of a sliding bushing -14- with sets of helical toothing on the outside -15- and inside -16-. so that the outer teeth -15- of said bushing -14- coincide with the teeth -17- of the gear -13 inside, allowing it to engage perfectly with the bushing -14- and to act as a sliding toothed shaft.

Likewise, the inside teeth -16- of the bushing -14- match the gearing -18- on the end of the camshafts -2- and -3-, fitting together perfectly and allowing said bushing -14- to slide along the shaft, though linked to it by the engaging teeth. This movement is produced by the axial displacement fork -19- inside the peripheral throat -20- forming part of the sliding bushing -14- with the thrust from the bar -21 - fitted on the displacement fork -19-. The toothing is helical and each set is the reverse of the other.

With this arrangement, as shown in the two sequences illustrated in FIGS. 2 and 3, when the bushing -14- slips axially, an offset occurs between the gear -13- and the shaft —2- and —3-, making it possible to vary the angular setting of each camshaft in relation to the crankshaft continuously and at will.

A comparison of the sequences in FIGS. 4, 5, and 6 and those in FIGS. 7, 8 and 9 shows that, with this independent cam —4- and —5-mechanism and the action of the sliding bushing —14-shifter, it is possible to substantially change the distribution of an internal combustion engine —22- continuously, with the engine running, and at will.

In the example shown in the figures, the admission valve has been made to change its distribution by the following values:

Case 1:

Advance on admission opening—14° before top dead centre.

Delay to admission close—30° after bottom dead centre.

Case 2:

Advance on admission opening—40° before top dead centre.

Delay to admission close—80° after bottom dead centre.

The first of these cases benefits the engine at slow speeds while the second is for a fast-running engine, in which case continuous variations can be obtained, with the engine running, with intermediate values which are suitable for each engine running regime.

Each and every one of the parts comprising the improved device to activate variable distribution valves for internal combustion engines in the invention is deemed to have been fully described and it remains only to be pointed out that the different parts may be manufactured in a variety of materials, sizes and shapes, and constructive variations can be made to the design as practice suggests, provided that this does not alter the essential aspects which are the subject of this registration of a Model of Utility.

I claim:

1. An improved device to activate variable gas exchange valves of internal combustion engines wherein, essentially, there are two camshafts, upper and lower, with cams for the combined operation of the valves, so that the upper camshaft acts and contacts a first rocker arm mounted on a fixed shaft and, on its end of greater rocker movement, the first rocker arm has a shaft in pin form which is a mobile shaft of a second, lower, rocker arm of angular form, upon which the lower camshaft cam contacts, the second rocker arm pivoting on the mobile shaft and, because of its angular form, the opposite end to that contacting the lower cam is applied to a valve stem, opening being performed by just one of the cams while closing is the sole consequence of the operation of the other cam, always in combined complementary action.

2. An improved device to activate the variable gas exchange valves of internal combustion engines as set forth in claim 1 wherein, essentially, the variation in the camshaft timing is obtained with a mechanism installed between a gear and a respective camshaft, with a sliding bushing between the two which has internal and external helical splines, the external splines of said bushing mesh with internal splines of the gear, the internal splines of the bushing mesh with splines on the camshaft, the bushing slips freely along the cam shaft, the movement of the bushing is produced by a fork in a peripheral throat forming part of the bushing, while the thrust or movement to vary the timing comes from a bar fitted on said fork so that the angular setting of each camshaft in relation to the crankshaft can be varied continuously.

* * * * *